US011045711B2

(12) United States Patent
Kramer et al.

(10) Patent No.: US 11,045,711 B2
(45) Date of Patent: Jun. 29, 2021

(54) SKI MANAGEMENT DEVICE

(71) Applicant: MagSkiTies LLC, Casper, WY (US)

(72) Inventors: Michael Todd Kramer, Casper, WY (US); Nicol Thompson Kramer, Casper, WY (US)

(73) Assignee: MagSkiTies LLC, Casper, WY (US)

( * ) Notice: Subject to any disclaimer, the term of this patent is extended or adjusted under 35 U.S.C. 154(b) by 0 days.

(21) Appl. No.: 16/800,897

(22) Filed: Feb. 25, 2020

(65) Prior Publication Data

US 2020/0282292 A1 Sep. 10, 2020

Related U.S. Application Data

(60) Provisional application No. 62/813,548, filed on Mar. 4, 2019.

(51) Int. Cl.
*A63C 11/02* (2006.01)

(52) U.S. Cl.
CPC ..... *A63C 11/022* (2013.01)

(58) Field of Classification Search
CPC ..... A63C 11/021; A63C 11/022
USPC ..... 280/814, 815
See application file for complete search history.

(56) References Cited

U.S. PATENT DOCUMENTS 2,562,178 A * 7/1951 Djos ..... A63C 11/021 280/814
2,844,291 A 5/1956 Mcpheeters
3,266,633 A 8/1966 Graebner
3,279,008 A * 10/1966 Wallach ..... A63C 11/021 24/16 PB
3,366,297 A * 1/1968 Barsell ..... A63C 11/021 294/166
3,479,044 A * 11/1969 Peis ..... A63C 11/022 280/601
3,620,543 A * 11/1971 Peis ..... A63C 11/022 280/601
3,731,348 A * 5/1973 Luehne ..... A44B 18/00 280/814
3,746,177 A 7/1973 Vilotti
3,936,067 A * 2/1976 Link ..... A63C 11/021 280/814
3,947,927 A * 4/1976 Rosenthal ..... A63C 11/025 24/306
3,994,048 A * 11/1976 Rosenthal ..... A63C 11/025 24/306

(Continued)

FOREIGN PATENT DOCUMENTS

FR 3077501 A1 2/2018

OTHER PUBLICATIONS

Ski Magazine, "Ski Stander", Dec. 1994, p. 226.

*Primary Examiner* — Jeffrey J Restifo
(74) *Attorney, Agent, or Firm* — Martensen IP; Michael C. Martensen

(57) ABSTRACT

A magnetic ski management device encases and immobilizes a pair of skis while incorporating a magnetic implement attracting the device/ski combination to ferromagnetic surfaces. The ski management device of the present invention joins and secures a pair of skis together having a magnetic implement (device) aligned with but offset from the juncture between the skis establishing a magnetic attractive force between the ski management device, including the associated skis, and any ferromagnetic surface.

25 Claims, 5 Drawing Sheets

(56) References Cited

U.S. PATENT DOCUMENTS 4,120,437 A * 10/1978 Hara ..... A63C 11/025 24/306
4,269,435 A * 5/1981 Jarvenkyla ..... A63C 11/025 280/814
4,274,571 A * 6/1981 Lafreniere ..... A63C 11/025 211/70.5
4,465,304 A * 8/1984 Hicks ..... A63C 11/027 280/814
4,470,528 A * 9/1984 Dyess ..... A63C 11/025 224/257
4,531,661 A * 7/1985 Santy ..... A63C 11/025 224/191
4,540,198 A * 9/1985 Kyburz ..... A63C 11/026 188/1.12
4,553,779 A * 11/1985 Shortridge ..... A63C 11/025 224/917
4,817,837 A * 4/1989 Grover ..... A63C 11/021 224/250
5,012,921 A * 5/1991 Becker ..... A63C 11/023 206/315.1
5,022,678 A * 6/1991 Mayfield ..... A63C 11/00 150/154
5,056,819 A * 10/1991 Hayes ..... A63C 11/22 280/809
5,056,820 A * 10/1991 Des Prez ..... A63C 11/025 280/814
5,066,044 A * 11/1991 Adasek ..... A63C 11/027 280/815
5,094,479 A * 3/1992 Shields ..... A63C 11/025 224/917
5,104,017 A * 4/1992 Vandagriff ..... A63C 11/025 224/250
5,197,760 A * 3/1993 Schollenberger ..... A63C 11/02 224/917
5,210,486 A 4/1993 Holbrook
5,282,535 A * 2/1994 Rowland ..... A63C 11/023 206/315.1
5,335,835 A * 8/1994 Hogan ..... A45F 3/14 224/257
5,356,180 A * 10/1994 Adasek ..... A63C 11/027 280/814
5,423,466 A 6/1995 Moon
5,427,291 A * 6/1995 Smith ..... A63C 11/025 224/250
5,450,991 A * 9/1995 Neading ..... A45F 3/00 224/578
5,464,138 A * 11/1995 Rodriguez ..... A63C 11/025 224/265
5,468,036 A * 11/1995 Brown ..... A63C 11/021 294/147
5,611,588 A * 3/1997 Mencel ..... A63C 11/02 280/814
6,273,272 B1 * 8/2001 Hake ..... A63C 11/028 211/4
6,827,245 B1 * 12/2004 Yetka ..... B60R 9/12 224/316
7,374,207 B2 * 5/2008 McCoy ..... A63C 5/062 280/809
8,371,614 B2 * 2/2013 Rodriguez ..... A63C 11/025 280/814
8,403,278 B1 3/2013 Kasbohm
8,491,011 B2 * 7/2013 Valaas ..... A63C 11/021 280/814
8,616,600 B2 * 12/2013 Owen ..... A63C 11/025 294/154
8,695,935 B1 4/2014 Kasbohm
8,739,453 B1 6/2014 Conner
8,746,769 B2 * 6/2014 Owen ..... A63C 11/025 294/154
8,973,297 B2 3/2015 Boggess et al.
9,610,901 B2 4/2017 Sheehan
9,733,036 B2 8/2017 Tucker et al.
10,493,355 B2 * 12/2019 Reid ..... A45F 5/021
10,695,652 B1 * 6/2020 Shute ..... B63B 32/80
2015/0223439 A1 8/2015 Caudle

* cited by examiner

SKI MANAGEMENT DEVICE

RELATED APPLICATION

The present application relates to and claims the benefit of priority to U.S. Provisional Patent Application Ser. No. 62/813,548 filed 4 Mar. 2019 which is hereby incorporated by reference in its entirety for all purposes as if fully set forth herein.

BACKGROUND OF THE INVENTION

Field of the Invention

Embodiments of the present invention relate, in general, to a ski management device and more particularly to a device for securing skis using a combination of ductile material and magnetic components.

Relevant Background

Skiing is a popular winter sport. Invariably, engaging in the sport of skiing requires certain equipment of which the most fundamental pair is a pair of skis. Skis coming in many different variations, sizes and shapes depending on the which subcategory of skiing the participant desires to experience. Alpine, Nordic, freestyle, telemark and backcountry are several different subcategories of skiing. And in each subcategory additional refinements can exist. For example, alpine skis include powder, all mountain, carving or front side classifications while Nordic skis can be grouped into cross-country, skate, track, telemark, touring and the like.

As one's skill increases a pair of skis coupled to a pair of boots though a set of bindings becomes akin to an extended limb enabling one to glide over snow and traverse vast distances in winter. Yet when unattached skis represent a large and awkward piece of fitness equipment that needs to be transported to the "sports arena," whether that arena be a ski resort or a local trailhead.

Ski management is cumbersome especially when multiple pairs of skis are involved. And while alpine skis are more commonly adapted to include ski brakes that may aid in joining a pair of skis together, Nordic skis lack such features. Ski resorts have long recognized a need to have racks available on which skiers can rest and store their skis. But such racks are only found near lifts, lodges and resort restaurants. Laying skis on the ground such as in the parking lot invites damage not only to the skis but those who attempt to walk over such loosely strewn about skis. And leaning skis along a building or automobile may be a good temporary solution, but even a small gust of wind or careless bystander can initiate a cascade of falling equipment damaging both the skis and the underlying building/auto. A need exists for a versatile ski management tool that can be used in a variety of locations, conditions and that is applicable to any type of ski variety.

That need is emphasized when considering the care and attention given to the working surface of the ski. Skis are tuned for optimal performance. The edges are sharpened, and the bottoms waxed with material specifically designed for certain snow conditions. Rubbing the bottom of the skis together removes such coatings and dulls edges as does laying skis on parking lots, roads and other non-snow environments. Even with tightly bound together road vibration during travel can cause excessive rubbing and impacts between pairs of skis, scratching the bases of the skis, reducing the life of the skis and dulling the edges and working surface of the skis, which in turn can reduce the speed and safety of the ski.

Before skis are carried to the slopes, before they are marshaled in the parking lot and before they are piled into a car-top carrier, skis are stored in a basement, garage, back room or the like. Typically, skis are stored or staged vertically to reduce their impact on available storage space. Regardless of their orientation, skis should be stored in a way that protects them from scratches, pressure and debris, especially the bottoms and the edges of the skis. Because of this, skis are often leaned on a rack similar to the method of leaning skis on a vehicle (often metal) or against a wall almost inviting an unexpecting nudge, bump or shove to send them tumbling to the ground. Nonetheless, skis need to be accessible and readily available should the opportunistic snowstorm arrive overnight. A need remains for a device or tool to manage and secure skis that does not impede their accessibility.

These and other deficiencies of the prior art are addressed by one or more embodiments of the present invention. Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A ski management device encases and manages a pair of skis using a flexible sleeve that can be attached to a ferromagnetic surface using a magnetic implement incorporated into the device. The device of the present invention includes a flexible sleeve having a sleeve width and a sleeve length, the sleeve length being greater than the sleeve width, that is substantially elliptical/oval in shape. A semi-rigid planar separator is interposed within, bifurcating, the sleeve throughout the sleeve length. The separator width is aligned with a major axis of the sleeve with each length edge of the separator making contact with the sleeve along the sleeve length. The separator is affixed to the sleeve between each length edge of the separator and the sleeve so that when in use a pair of skis are held apart by the separator. A magnetic implement (magnet) is coupled to the sleeve, aligned with the sleeve length and configured to attach the sleeve and separator to a ferromagnetic substance using a magnetic force.

Other features of the present invention include the sleeve length being greater than or equal to the sleeve width. In one embodiment the sleeve length is greater than 1.5 times the sleeve width. In another version of the present invention, the sleeve is affixed to the separator at two junctures forming a flexible, yet unified oval. In yet another embodiment of the present invention the sleeve comprises a first and second panel that wrap around the skis and separator and adhere to themselves. In such an embodiment the magnetic implement is aligned with the single juncture between the separator and panels. The panels are configured so as to not obfuscate the magnetic implement.

The sleeve of the present invention can be configured, in other embodiments, to encase a pair of alpine, Nordic, skate, touring skis or the like. In each case the magnetic implement is sized based on the type of ski being housed within the sleeve.

The magnetic implement may, in one embodiment, be a bar magnet while in another be a disks or combination of small magnetic components or the like. The magnet(s) can be affixed to the sleeve/separator juncture or removably housed within an elastic sheath.

Another embodiment of the present invention is a system for ski organization having a ski management device, at least one pair of skis and a ferromagnetic surface. The ski management device includes flexible sleeve configured to encase the pair of skis wherein the skis are separated by a semi-rigid planer separator. A magnetic implement is aligned with and coupled to the sleeve/separator along the sleeve length. With the skis encased by the sleeve, the ski management device can be attached to a ferromagnetic surface using magnetic attractive forces.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1A:
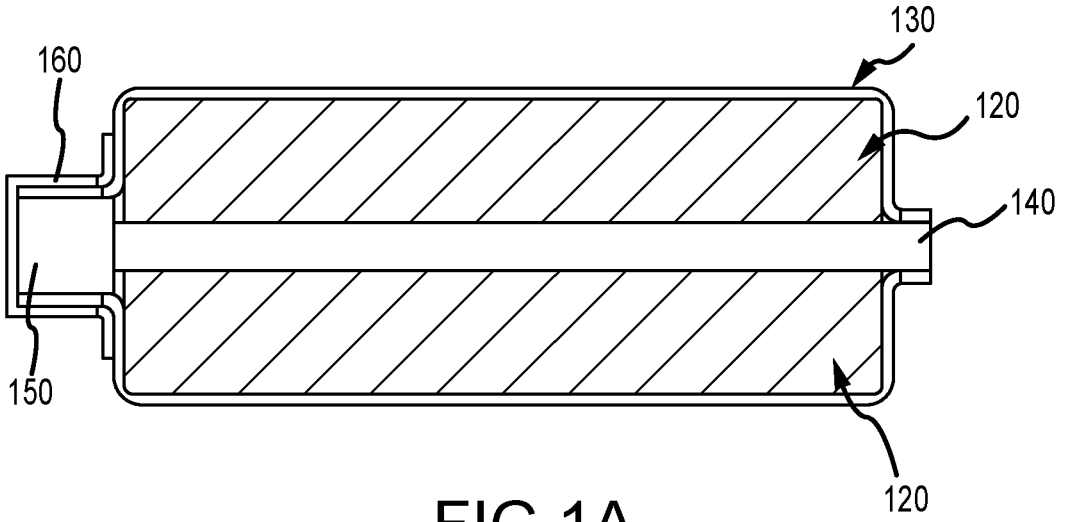
FIG. 1A and FIG. 1B shows an end view of a ski management device with and without skis, respectively, according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

A magnetic ski management device encases and immobilizes a pair of skis while incorporating a magnetic implement attracting the device to ferromagnetic surfaces. The ski management device of the present invention joins and secures a pair of skis together while incorporating a magnetic implement (device) aligned with, but apart from, the skis establishing a magnetic attractive force between the ski management device, including the associated skis, and any ferromagnetic surface.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces. If used, the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined herein, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Figure 1B:
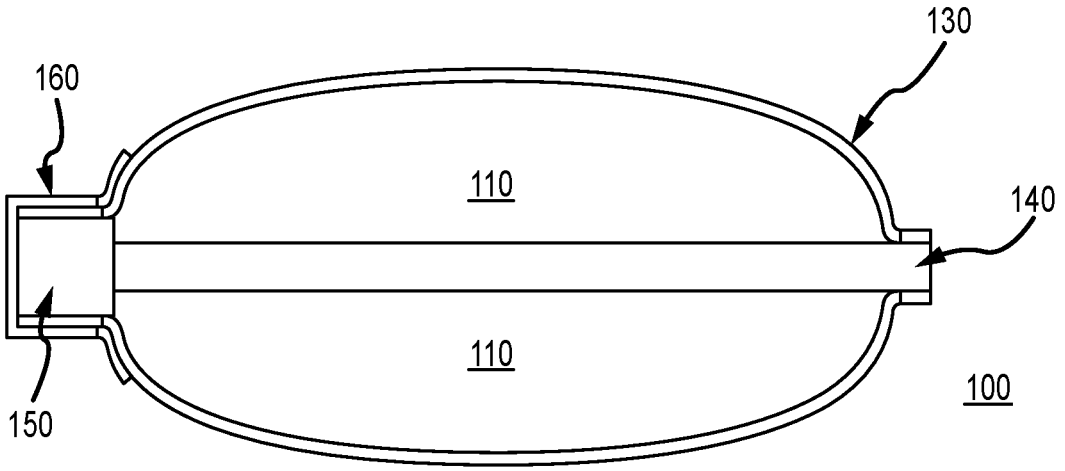
Figure 2:
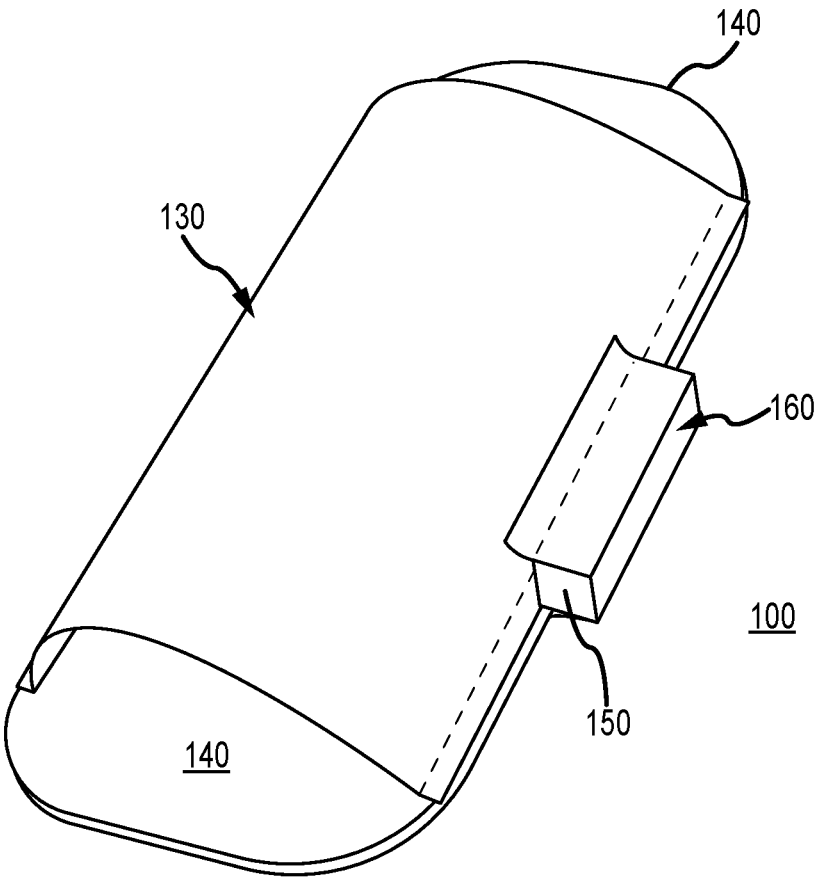
FIG. 2 is a perspective view of a ski management device, according to one embodiment of the present invention.

The ski management device 100 of the present invention, as shown in FIGS. 1A, 1B and 2, provides, in one embodiment, a flexible, elliptical shaped, sleeve through which skis can be placed. The interior volume 110 of the sleeve 130 is configured to accept and adapt to a pair of skis 120 such as Nordic (cross country or skate) skis. Other configurations and sizes of the sleeve 130 are contemplated to accept different types of skis such as alpine or backcountry and the like. As the skis 120 are guided into the sleeve 130 the sleeve conforms to the ski shape as shown in FIG. 1A. Upon inclusion of a second ski 120, the volume of the sleeve is occupied securing the skis together within the ski management device 100. As one or reasonable skill in the relevant art will recognize the bottom of the ski is tuned for a specific type of activity and condition. In Nordic skiing the type of wax and surface of the bottom of the ski are key to gaining unidirectional traction in the snow. Having the bottoms of opposing skis rest on each other or be bound together is detrimental to their operational state. Accordingly, the present invention includes a semi-rigid planar separator 140 bifurcating the sleeve 130 and interposed between the skis 120.

With attention to FIGS. 1A, 1B and FIG. 2, a flexible substantially elliptical (when viewed as a cross-section) sleeve having a sleeve length greater than its width is bifurcated by a semi-rigid planar separator 140. The ellipse, formed by the sleeve 130, has a minor axis substantially less than its major axis and is configured to conform to the shape of the skis upon their insertion.

The sleeve 130 is constructed of a flexible and durable material that is inelastic yet tolerant to cold temperatures. As one of reasonable skill in the relevant would appreciate, skis are used in snowy, cold conditions. Thus, the material chosen to manage the skis as part of the ski management device of the present invention must not only be durable but retain its flexibility in a cold environment. In one embodiment the sleeve and/or separator is composed of a material selected from the group consisting of Polymethyl Methacrylate (PMMA), Polycarbonate (PC), Polyethylene (PE), Polypropylene (PP), Polyethylene Terephthalate (PETE or PET), Polyvinyl Chloride (PVC), Polysiloxanes (silicone), and Acrylonitrile-Butadiene-Styrene (ABS). In another embodiment the sleeve and/or separator is composed of a natural material selected from a group consisting of leather, canvas, rubber, natural fiber cloth and the like.

A magnet or magnetic implement 150 is coupled to the sleeve and aligned with the sleeve length at a juncture between the separator 140 and the sleeve 130. Upon the sleeve 130 being occupied by a pair of skis 120 as is shows in FIG. 1A, the magnetic implement 150 resides to the side of, but apart from, the skis 120 in line with the separator 140. In such a position the magnetic implement 150 can be used to attach the ski management device 100, and any encased skis 120, to a ferromagnetic surface or, in another embodiment, to another ski management device.

In many instances two ski management devices 100 will be employed to secure a pair of skis. For example, one may be used to encase and secure a pair of skis forward of the ski bindings and another ski management device used to secure the skis aft of the ski bindings. By consistently orientating the ski management device on the pair of skis the magnetic implement associated with each ski management device is positioned on the same side or edge. Using the magnetic forces exhibited by each magnetic implement, the ski management devices and the pair of skis can be attached to a ferromagnetic surface such as a side of a vehicle or a metal post, panel or portion of wall.

In another embodiment a series of ferromagnetic (metal) panels can be placed on a wall of a storage area and used to store and organize a plurality of skis. With each pair of skis encased by one or more ski management devices, a horizontal metal strip on the wall of a storage area can serve as storage rack. Skis can rest of the floor upright, held in a standing position by magnetic forces exhibited by the magnetic implement. In other embodiments two or more ferromagnetic surfaces combined with two or more ski management devices per pair of skis can be used to store the skis horizontally.

Another application of the ski management device of the present invention is manual transportation of two or more pairs of skis. Using a pair of ski management devices to secure a first pair of skis and another pair of ski management device to secure another pair of skis, the magnetic implements of each ski management device can be configured to couple one pair of skis (ski management devices) to the other. By doing so a user can carry two or more pairs of skis in a similar fashion as a single pair of skis. Moreover, the magnetic implement of the ski management device can also be used to couple a pair of poles to a pair of skis making essentially a handle by which to carry the skis to the slopes or to the track.

In one embodiment of then present invention the magnetic implement 150 is a magnetic bar having an elongated side aligned with the sleeve length and coupled to the sleeve outside of the juncture between the sleeve and semi-rigid separator. In one version of the present invention the magnetic bar is removably housed within an elastic sheath 160. In other embodiments the magnetic bar is directly affixed to the junction between the sleeve and the separator. In yet other versions of the present invention the magnetic implement may be a disk or magnetic surface such as magnetic tape integrated with the sleeve. The magnetic implement may also be a series of smaller magnetic components positioned along the sleeve length whose aggregate magnetic force is sufficient to support a pair of skis.

While FIGS. 1A, 1B and FIG. 2 illustrate the ski management device having a single magnetic implement associated with one juncture of the sleeve and the separator, other embodiments of the present invention may include a magnetic implement on each juncture. By having a magnetic implement on each juncture (on each side of the pair of skis) the positioning of the skis on a ferromagnetic surface is universal.

Figure 3:
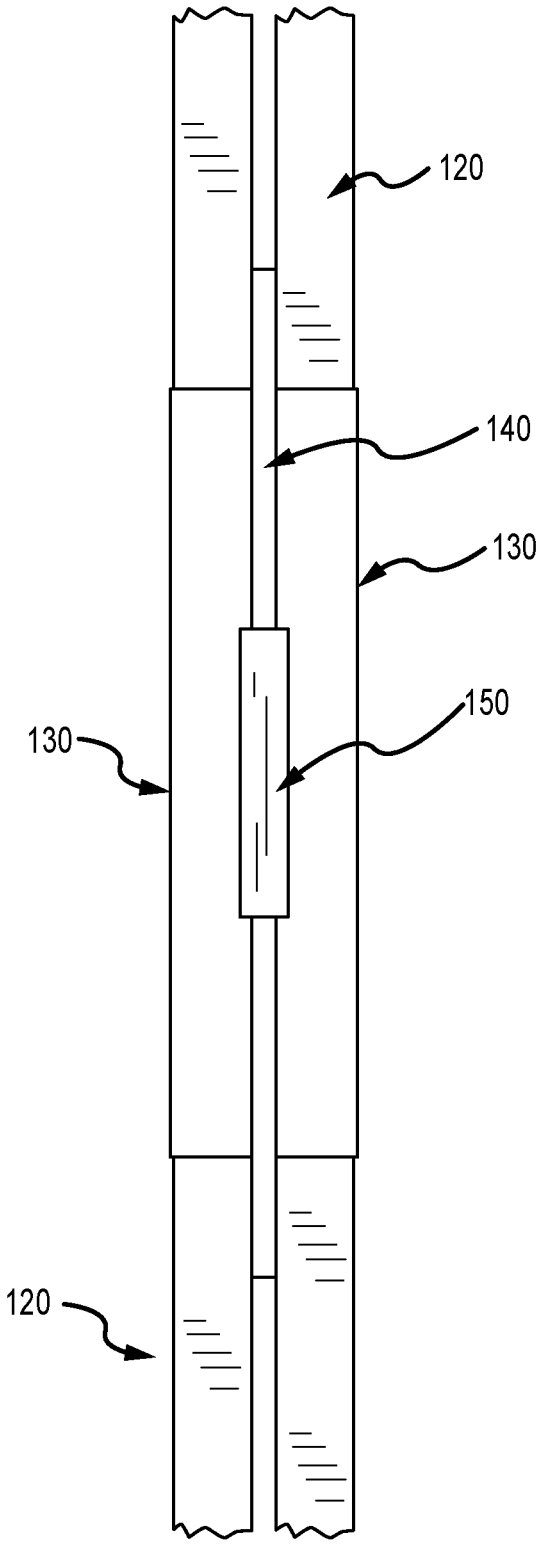
FIG. 3 is a side view of a ski management device of the present invention in association with a pair of skis.

FIG. 3 is a side view of a ski management device of the present invention encasing a pair of skis. As depicted a pair of skis are inserted into the sleeve of a ski management device with the bottom of each ski facing each other. The bottom of each ski is separated and prevented from making contact with each other by a separator which bifurcates the ski management device. Aligned with the separator and the sleeve length is the magnetic implement, which, in one embodiment and as shown in FIG. 3, is an elongated bar.

Figure 4:
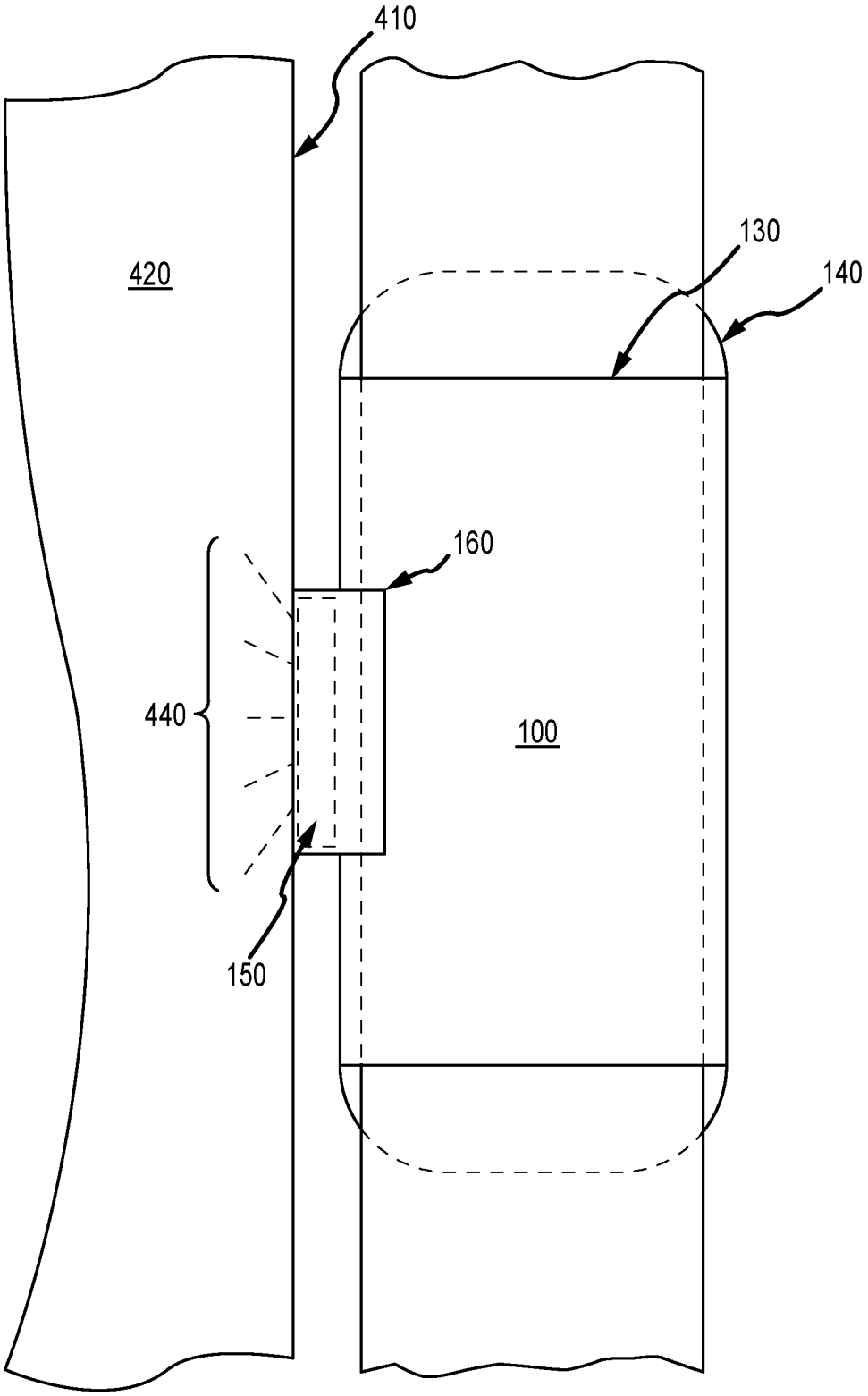
FIG. 4 is an expanded side view of the ski management device of the present invention in association with a pair of skis and a ferromagnetic surface.

FIG. 4 is a front view of the ski management device and skis of FIG. 3 in proximity to a ferromagnetic surface. As shown the skis are encased by the sleeve 130 of the ski management device 100 with the separator 140 interposed between the bottom surfaces of each ski. Aligned with the sleeve length and positioned at the side of the skis, which is coexistent with the juncture between the sleeve 130 and the separator 140, is a bar magnet version of the magnetic implement 150. The bar magnet is secured to the ski magnet device by, in this embodiment, an elastic sheath (not shown). The sheath enables the magnet to be replaced or augmented with additional magnets if a greater magnetic force is desired/required. In other embodiments the magnetic implement 150 is affixed or bound directly to the juncture between the separator 140 and sleeve 130 and the magnetic implement may take a variety of shapes while still exhibiting the functional characteristics.

The magnetic implement is attracted to any ferromagnetic material by a magnetic force 440. The planar surface 410 shown in FIG. 4 is, in this embodiment, composed of a ferromagnetic material 420 such as iron, steel or the like. The surface may be a metal plate secured to a wall in a storage area or the side of a vehicle. It may also be a metal post or light pole near a trail head. Any ferromagnetic material can be used to secure/store the ski management device along with the encased skis.

Figure 5A:
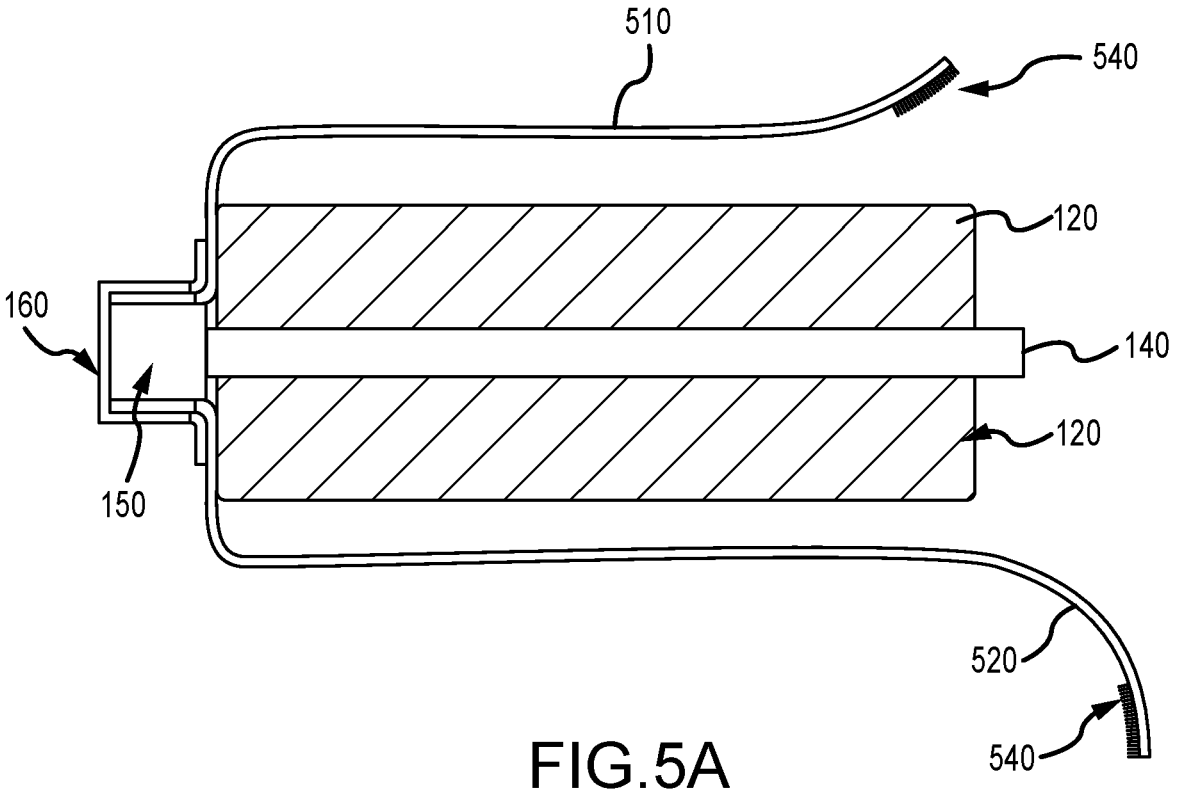
FIG. 5A and FIG. 5B show end views of a configurable version adaptable to accept skis of differing dimensions, according to one embodiment of the present invention.
Figure 5B:
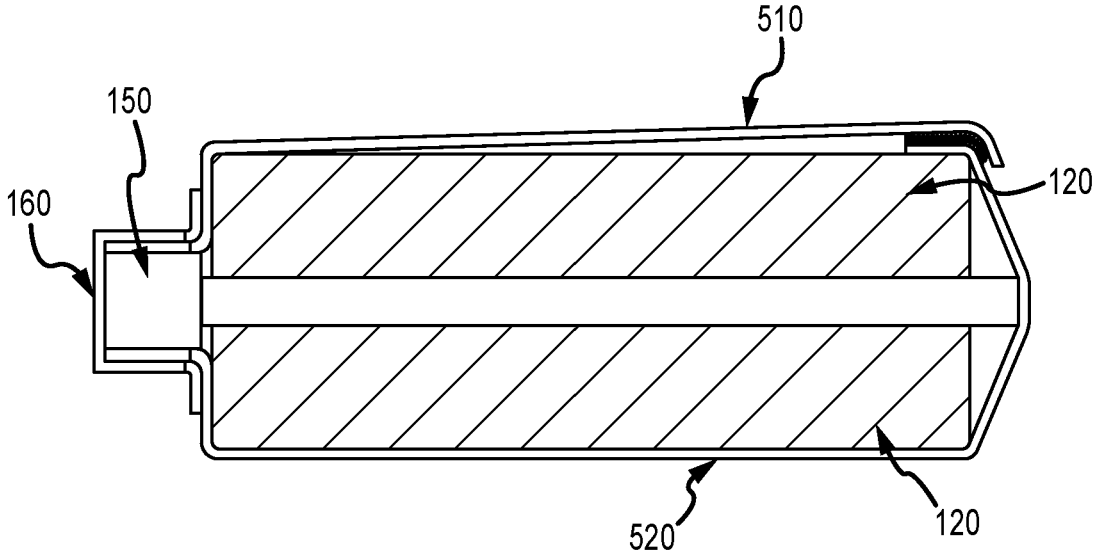

As one of reasonable skill in the relevant art will appreciate skis come in many sizes and shapes. Nordic skis are characterized as being longer and skinner than alpine skis. Backcountry and skate skis tend to merge the two skiing disciplines. FIG. 5 shows an adjustable version of the ski management device of the present invention. Rather than have a unified sleeve joined to the separator 140 at two junctures, the ski management device depicted in FIG. 5 include a first panel 510 and a second panel 520 conjoined/affixed to the separator 140 at a single juncture along the sleeve length. In the embodiment shown in FIG. 5, the magnetic implement 150 is housed in a sheath 160 at the same juncture opposite the separator 140. The first panel 510 and second panel 520 of the sleeve 130 are configured to wrap around the skis 120 and overlap without obfuscating the magnetic implement 150. In one embodiment of the present invention the surfaces of the first and second panel include a hook and loop engagement 540 mechanism so as to adhere to themselves. Other means by which the panels may adhere to themselves are possible and contemplated and are indeed within the scope of the present invention.

Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

What is claimed is:

1. A ski management device; comprising:

a flexible sleeve having a sleeve width and a sleeve length wherein the sleeve length is greater than the sleeve width and wherein a right cross section of the sleeve is an ellipse having a minor axis substantially less than a major axis;

a semi-rigid planar separator having a separator length with a length edge and a separator width with a width edge, the separator length being greater than the separator width, and wherein the separator is interposed within and bifurcating the sleeve throughout the sleeve length and wherein the separator width is aligned with the major axis of the sleeve, each length edge making contact with the sleeve along the sleeve length and wherein the separator is affixed to the sleeve between each length edge of the separator and the sleeve; and an elongated magnetic implement coupled to the sleeve and aligned with the sleeve length, wherein the magnetic implement is configured to attach the sleeve and separator to a ferromagnetic substance using a magnetic force.

2. The ski management device of claim 1, wherein the sleeve length is greater than 1.5 times the sleeve width.

3. The ski management device of claim 1, wherein the sleeve length is greater than or equal to the sleeve width.

4. The ski management device of claim 1, wherein the sleeve is composed of a material selected from a group consisting of leather, canvas, rubber, and natural fiber cloth.

5. The ski management device of claim 1, wherein the sleeve is composed of a material selected from the group consisting of Polymethyl Methacrylate (PMMA), Polycarbonate (PC), Polyethylene (PE), Polypropylene (PP), Polyethylene Terephthalate (PETE or PET), Polyvinyl Chloride (PVC), Polysiloxanes, and Acrylonitrile-Butadiene-Styrene (ABS).

6. The ski management device of claim 1, wherein the sleeve is substantially elliptical having a longitudinal axis and wherein the semi-rigid planar separator bifurcates the sleeve along the longitudinal axis at a juncture.

7. The ski management device of claim 1, wherein the sleeve includes a first panel and a second panel affixed to the semi-rigid planar separator at a juncture and is configured to wrap around the semi-rigid planar separator so as to overlap and adhere to itself using a hook and loop surface.

8. The ski management device of claim 1, wherein the sleeve is configured to accept and encase a pair of skis.

9. The ski management device of claim 8, wherein the pair of skis are separated by the semi-rigid planar separator within the sleeve.

10. The ski management device of claim 8, wherein the pair of skis are alpine skis.

11. The ski management device of claim 8, wherein the pair of skis are Nordic skis.

12. The ski management device of claim 8, wherein the pair of skis are skate skis.

13. The ski management device of claim 8, wherein the pair of skis are touring skis.

14. The ski management device of claim 1, wherein the magnetic implement is sized based on a ski type.

15. The ski management device of claim 1, further comprising an elastic sheath affixed to an exterior of the sleeve at a juncture between the sleeve and the semi-rigid planar separator.

16. The ski management device of claim 15, wherein the magnetic implement is housed within the elastic sheath.

17. The system for ski organization according to claim 16, wherein the at least one pair of skis are separated by the semi-rigid planar separator within the sleeve.

18. The ski management device of claim 15, further comprising a second elastic sheath affixed to the exterior of the sleeve at a second juncture wherein the second elastic sheath is configured to accept a second magnetic implement.

19. The ski management device of claim 1, wherein the magnetic implement is magnetic bar having an elongated side, the elongated side of the magnetic bar aligned with the sleeve length and wherein the magnetic bar is removably housed within an elastic sheath affixed to an exterior of the sleeve at a juncture between the sleeve and the semi-rigid planar separator.

20. A system for ski organization, comprising at least one pair of skis a ski management device configured to encase the at least one pair of skis, the ski management device characterized by a flexible sleeve having a sleeve width and a sleeve length wherein the sleeve length is greater than the sleeve width and wherein a right cross section of the sleeve is an ellipse having a minor axis substantially less than a major axis, a semi-rigid planar separator having a separator length with a length edge and a separator width with a width edge, the separator length being greater than the separator width, and wherein the separator is interposed within and bifurcating the sleeve throughout the sleeve length and wherein the separator width is aligned with the major axis of the sleeve, each length edge making contact with the sleeve along the sleeve length and wherein the separator is affixed to the sleeve between each length edge of the separator and the sleeve, and a magnetic implement aligned with the sleeve length; and a ferromagnetic surface wherein the magnetic implement is configured to attach the ski management device and the at least one pair of skis to the ferromagnetic surface using a magnetic force.

21. The system for ski organization according to claim 20, wherein the at least one pair of skis are alpine skis.

22. The system for ski organization according to claim 20, wherein the at least one pair of skis are Nordic skis.

23. The system for ski organization according to claim 20, wherein the sleeve is substantially elliptical having a longitudinal axis and wherein the semi-rigid planar separator bifurcates the sleeve along the longitudinal axis at a juncture.

24. The system for ski organization according to claim 20, wherein the magnetic implement is magnetic bar having an elongated side, the elongated side of the magnetic bar aligned with the sleeve length and wherein the magnetic bar is removably housed within an elastic sheath affixed to an exterior of the sleeve at a juncture between the sleeve and the semi-rigid planar separator.

25. The system for ski organization according to claim 24, wherein the elongated magnetic bar is sized based on a ski type.

* * * * *